US011596248B2

(12) United States Patent
Hawkins

(10) Patent No.: US 11,596,248 B2
(45) Date of Patent: Mar. 7, 2023

(54) NAPKIN HAVING A UTENSIL POCKET

(71) Applicant: Diane S. Hawkins, Hamburg, PA (US)

(72) Inventor: Diane S. Hawkins, Hamburg, PA (US)

( * ) Notice: Subject to any disclaimer, the term of this patent is extended or adjusted under 35 U.S.C. 154(b) by 89 days.

(21) Appl. No.: 16/737,369

(22) Filed: Jan. 8, 2020

(65) Prior Publication Data

US 2021/0204727 A1 Jul. 8, 2021

(51) Int. Cl.
*A47G 11/00* (2006.01)
*B31D 5/04* (2017.01)
*A47G 21/14* (2006.01)

(52) U.S. Cl.
CPC ..... *A47G 11/001* (2013.01); *B31D 5/04* (2013.01); *A47G 21/14* (2013.01)

(58) Field of Classification Search
CPC ..... A47G 11/001; A47G 21/14; B31D 5/04; B31D 1/04; B65B 49/12; B65B 51/06; B31B 70/628; B31F 1/2809; B31F 1/2818
USPC ..... 206/494; 493/276, 331
See application file for complete search history.

(56) References Cited

U.S. PATENT DOCUMENTS 1,430,654 A * 10/1922 Horwitt ..... A47G 11/001 206/494
1,730,074 A * 10/1929 Horwitt ..... A41B 15/00 221/67
1,844,468 A * 2/1932 Fischer ..... A47G 11/001 493/356
1,909,407 A * 5/1933 Hudson ..... B65D 71/02 206/494
4,800,108 A 1/1989 Swartz
5,011,017 A * 4/1991 Giesen ..... B31D 1/04 206/553
6,000,056 A 12/1999 Brady et al.
2007/0205212 A1* 9/2007 Klingel ..... B65H 37/04 221/33
2010/0272864 A1* 10/2010 Schreiner ..... A23P 20/20 426/93
2017/0000159 A1* 1/2017 Zhu ..... A23G 3/0097
(Continued)

FOREIGN PATENT DOCUMENTS

DE 202015102759 U1 2/2016
GB 2460858 A 12/2009

OTHER PUBLICATIONS

JMorrow, How to Add Pockets to Clothes, Feb. 18, 2013, 2MorrowsDresses.com, https://2morrowsdress.com/add-pockets/ (Year: 2013).*

*Primary Examiner* — Anna K Kinsaul
*Assistant Examiner* — Luis G Del Valle
(74) *Attorney, Agent, or Firm* — Culhane Meadows PLLC—Intellectual Property; Michael Dunnam

(57) ABSTRACT

A napkin having a utensil pocket is formed by folding a napkin in half along a first fold line, folding the napkin into quarters along a second fold line perpendicular to the first fold line to form a first quarter section and a second quarter section, and inserting a food grade glue in a pocket pattern between the first quarter section and the second quarter section. The pocket pattern has an opening at one end with respective sides formed by folding the first quarter section over the second quarter section to engage the food grade glue to glue together the first quarter section and the second quarter section to form the utensil pocket between the first quarter section and the second quarter section. When the napkin is made from cloth, the pocket may be stitched.

3 Claims, 6 Drawing Sheets

(56) References Cited

U.S. PATENT DOCUMENTS

| | | | | |
|---|---|---|---|---|
| 2017/0251843 | A1 | 9/2017 | Kennedy et al. | |
| 2017/0275070 | A1* | 9/2017 | Solomon | B65D 81/052 |
| 2018/0334311 | A1* | 11/2018 | Bittner | A61C 15/043 |

* cited by examiner

NAPKIN HAVING A UTENSIL POCKET

CROSS-REFERENCE TO RELATED APPLICATIONS

This application is related to U.S. Design patent application No. 29/719,871, filed even date herewith. The disclosure of that design patent application is incorporated herein by reference in its entirety.

TECHNICAL FIELD

This patent application describes a napkin that has been adapted to include a pocket for holding utensils.

BACKGROUND

Restaurants typically provide cloth or paper napkins and serving utensils to patrons. A significant portion of the server's time is spent wrapping the napkins around the serving utensils to create a place setting. The process is complicated by the requirement to wrap the napkin in a particular way to prevent the utensils from falling out of the place setting before placing a self-sticking paper band around the wrapped napkin and utensils. It is desirable to expedite the process of creating the place setting and keeping the place setting intact until ready to use.

SUMMARY

Various details for the embodiments of the inventive subject matter are provided in the accompanying drawings and in the detailed description text below.

In accordance with a first embodiment, a method of forming a napkin having a utensil pocket includes folding a napkin in half along a first fold line, folding the napkin into quarters along a second fold line perpendicular to the first fold line to form a first quarter section and a second quarter section, inserting a food grade glue in a pocket pattern between the first quarter section and the second quarter section, the pocket pattern having an opening at one end, and folding the first quarter section over the second quarter section to engage the food grade glue to glue together the first quarter section and the second quarter section to form the utensil pocket between the first quarter section and the second quarter section. The napkin may also be folded into eighths along a third fold line parallel to the second fold line. A place setting may be formed by inserting utensils into the utensil pocket and optionally rolling or folding the napkin in a direction perpendicular to the second fold line. The napkin may be a paper or cloth napkin. When the napkin is a cloth napkin, the first quarter section may be stitched to the second quarter section to form the utensil pocket. The utensil pocket has an opening at one end, one side parallel to the second fold line, and a second side parallel to the first fold line. In sample embodiments, the pocket pattern is an L-shape to a form side and a bottom to the utensil pocket.

This summary section is provided to introduce aspects of the inventive subject matter in a simplified form, with further explanation of the inventive subject matter following in the text of the detailed description. This summary section is not intended to identify essential or required features of the claimed subject matter, and the particular combination and order of elements listed this summary section is not intended to provide limitation to the elements of the claimed subject matter. Rather, it will be understood that the following section provides summarized examples of some of the embodiments described in the Detailed Description below.

BRIEF DESCRIPTION OF THE DRAWINGS

The foregoing and other beneficial features and advantages of the systems and methods described herein will become apparent from the following detailed description in connection with the attached figures, of which.

DETAILED DESCRIPTION OF ILLUSTRATIVE EMBODIMENTS

The inventive systems and methods may be understood more readily by reference to the following detailed description taken in connection with the accompanying figures and examples, which form a part of this disclosure. It is to be understood that the invention is not limited to the specific products, methods, conditions or parameters described and/or shown herein, and that the terminology used herein is for the purpose of describing particular embodiments by way of example only and is not intended to be limiting. Similarly, any description as to a possible mechanism or mode of action or reason for improvement is meant to be illustrative only, and the systems and methods described herein are not to be constrained by the correctness or incorrectness of any such suggested mechanism or mode of action or reason for improvement.

A detailed description of illustrative embodiments will now be described with reference to FIGS. 1-9. Although this description provides a detailed example of possible products and methods described herein, it should be noted that these details are intended to be by way of example only and in no way delimit the scope of the claimed subject matter.

Figure 1:
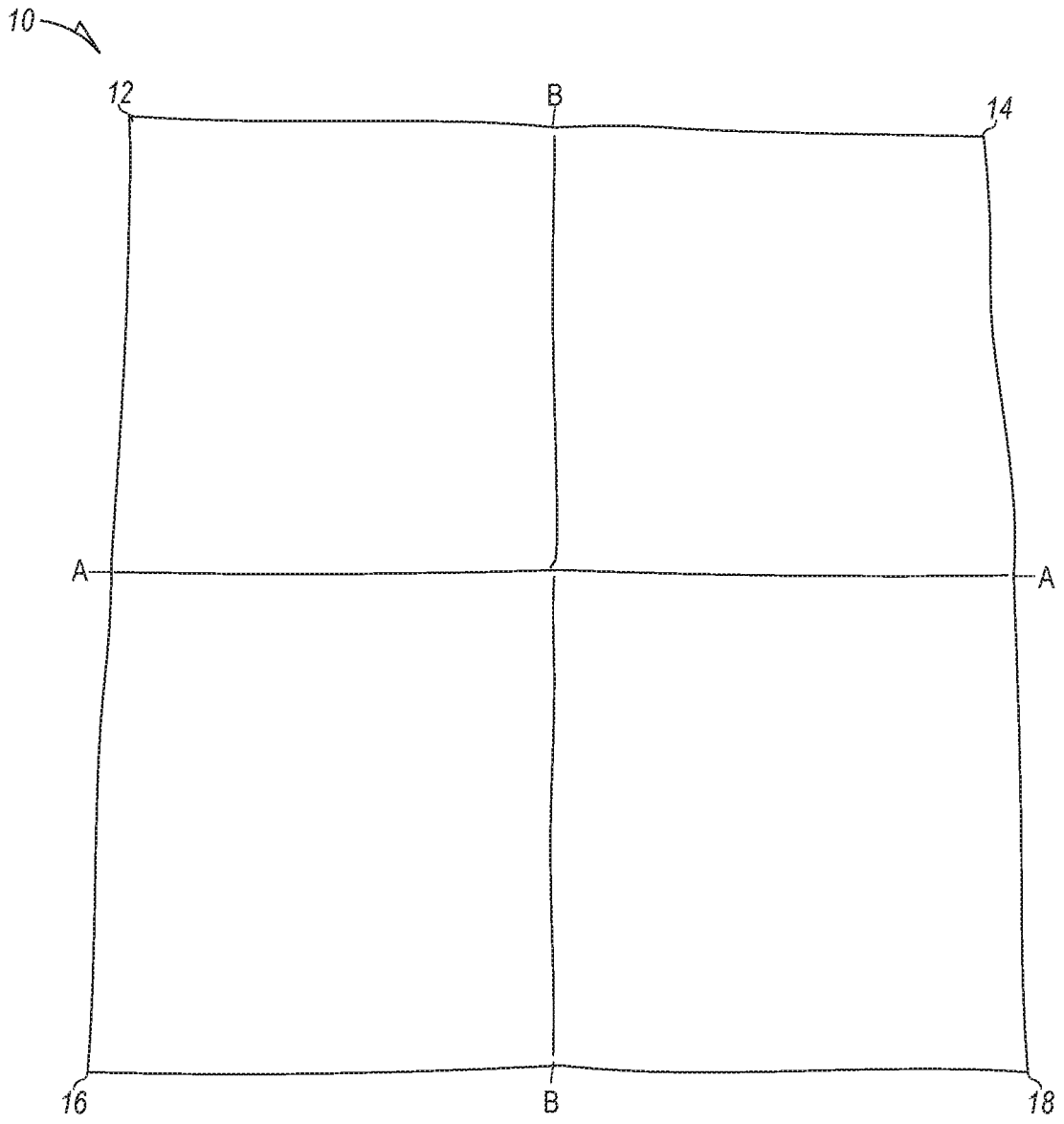
FIG. 1 illustrates an open napkin sheet from which a napkin having a utensil pocket is formed in a sample embodiment.

FIG. 1 illustrates an open napkin sheet 10 from which a napkin having a utensil pocket is formed in a sample embodiment. As illustrated, the napkin 10 has fold lines along axis A-A and along axis B-B. The napkin also has four respective corners 12, 14, 16, and 18. In sample embodiments, the napkin may be formed of cloth or of paper. FIGS.

2-9 below illustrate how this napkin sheet 10 is folded in sample embodiments to create a utensil pocket.

Figure 2:
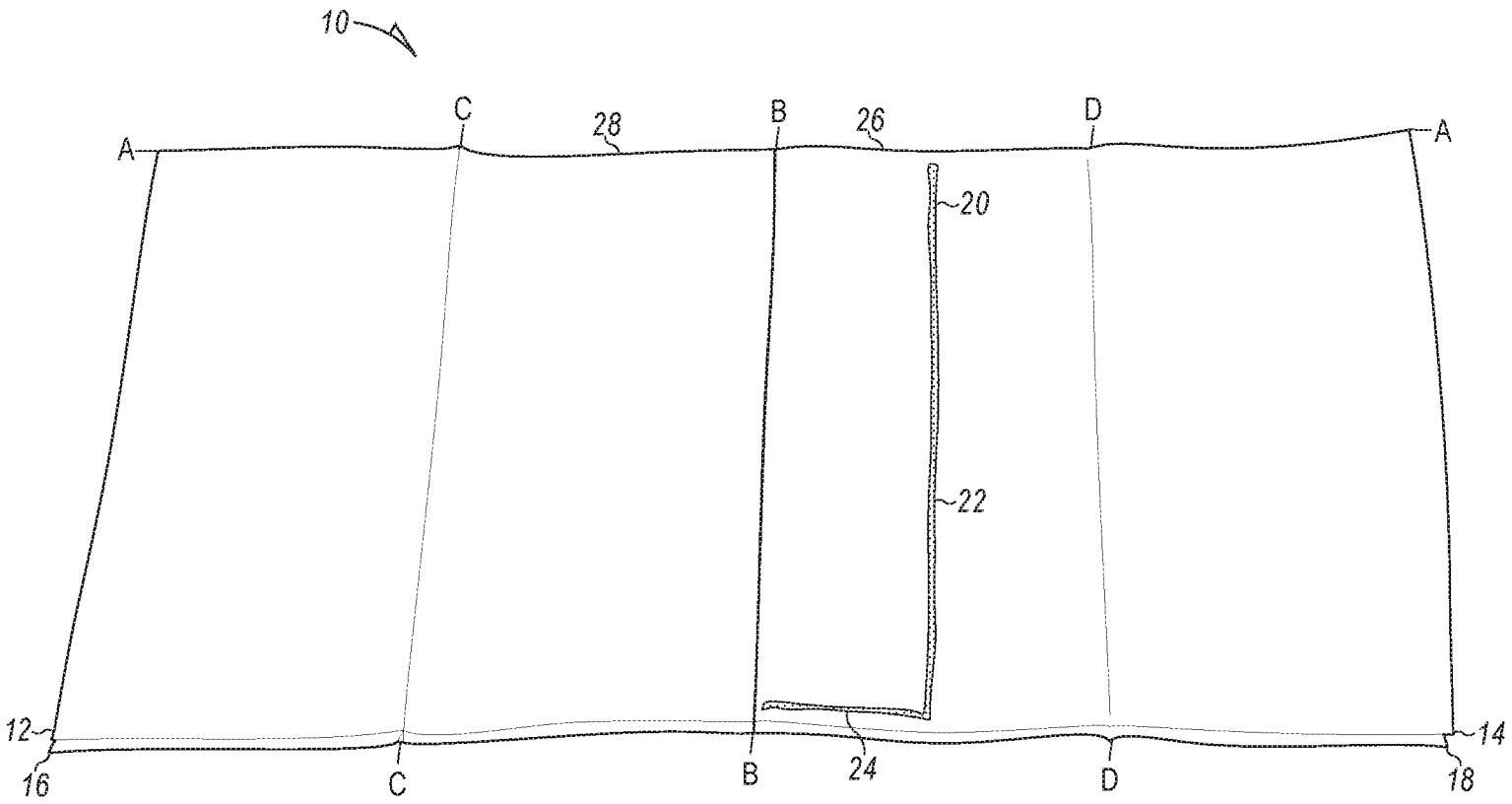
FIG. 2 illustrates the napkin sheet of FIG. 1 folded along axis A-A and having glue applied to form a utensil pocket in a sample embodiment.

FIG. 2 illustrates the napkin sheet 10 of FIG. 1 folded along axis A-A to bring together corners 12 and 16 and corners 14 and 18, respectively, to fold the napkin sheet 10 in half. The napkin sheet 10 is further folded along a fold line along axis B-B to fold the napkin sheet 10 into quarters. The napkin sheet 10 may also be further folded into eighths along folds C-C (into the page) and D-D (out of the page). In sample embodiments, before the napkin sheet 10 is folded into quarters along axis B-B, a food grade glue 20 is applied in an L-shape including side 22 and end 24 as illustrated. After the glue 20 is applied, folding the napkin sheet 10 into quarters along axis B-B by folding portion 28 over on top of portion 26 causes the glue 20 to glue together the portion 28 to the portion 26 to form a utensil pocket.

In sample embodiments, when the napkin sheet 10 is formed of paper, the food grade glue may comprise FDA approved food grade glues such as Master Bond brands EP 42HT-2FG, EP 30 HT, or EP 30 HV or Silicone brand RTV 4500 or NSF RTV silicone solvents. As would be apparent to those skilled in the art, other food grade glues that are safe to use with food products may be used.

On the other hand, when the napkin sheet 10 is formed of cloth, the food grade glue may be replaced by stitching that holds together the folds of the cloth.

Figure 3:
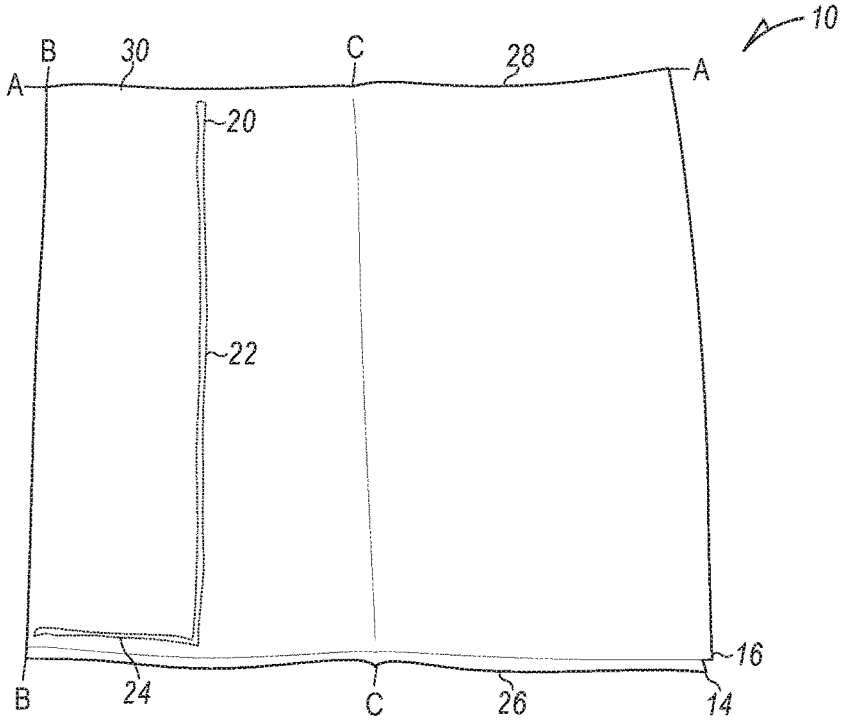
FIG. 3 illustrates the napkin sheet of FIG. 2 folded along axis B-B so that the glue interacts with respective faces of the folded sheet to form a utensil pocket in a sample embodiment.

FIG. 3 illustrates the napkin sheet 10 of FIG. 2 folded into quarters along axis B-B so that the glue 20 interacts with portions 26 and 28 of the folded sheet 10 to form a utensil pocket 30.

Figure 4:
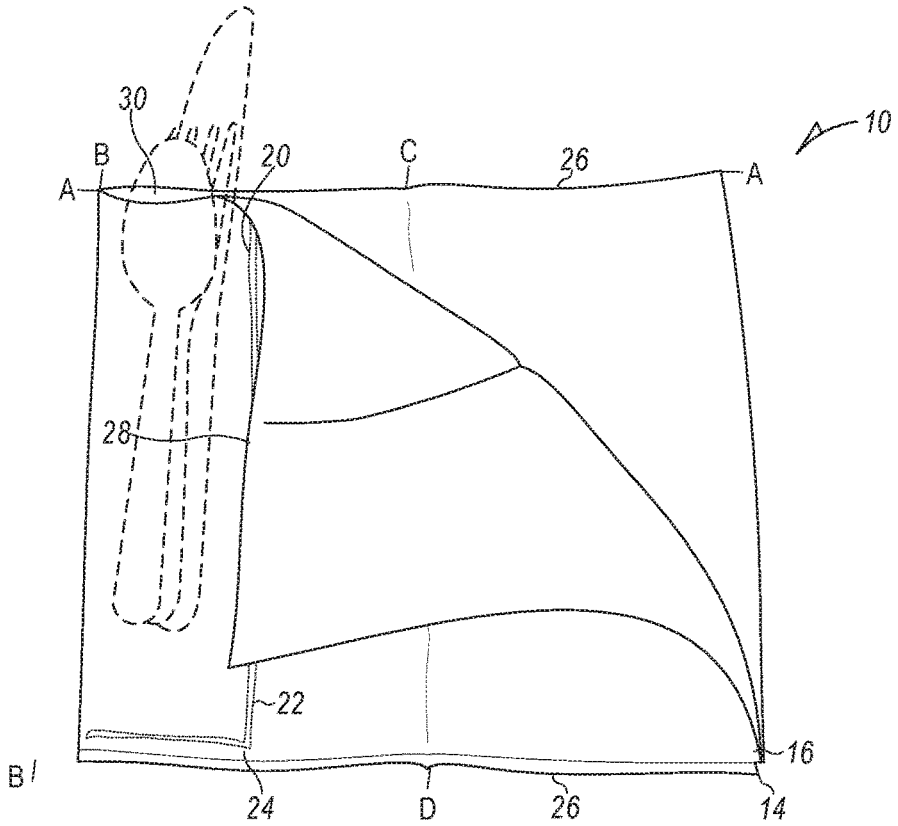
FIG. 4 illustrates the napkin sheet of FIG. 3 better illustrating the utensil pocket and showing the top layer of the napkin sheet folded back to show a lower layer of the napkin sheet in a sample embodiment.

FIG. 4 illustrates the napkin sheet of FIG. 3 better illustrating the utensil pocket 30 and showing the portion 28 of the napkin sheet 10 folded back to show the portion 26 of the napkin sheet 10.

Figure 5:
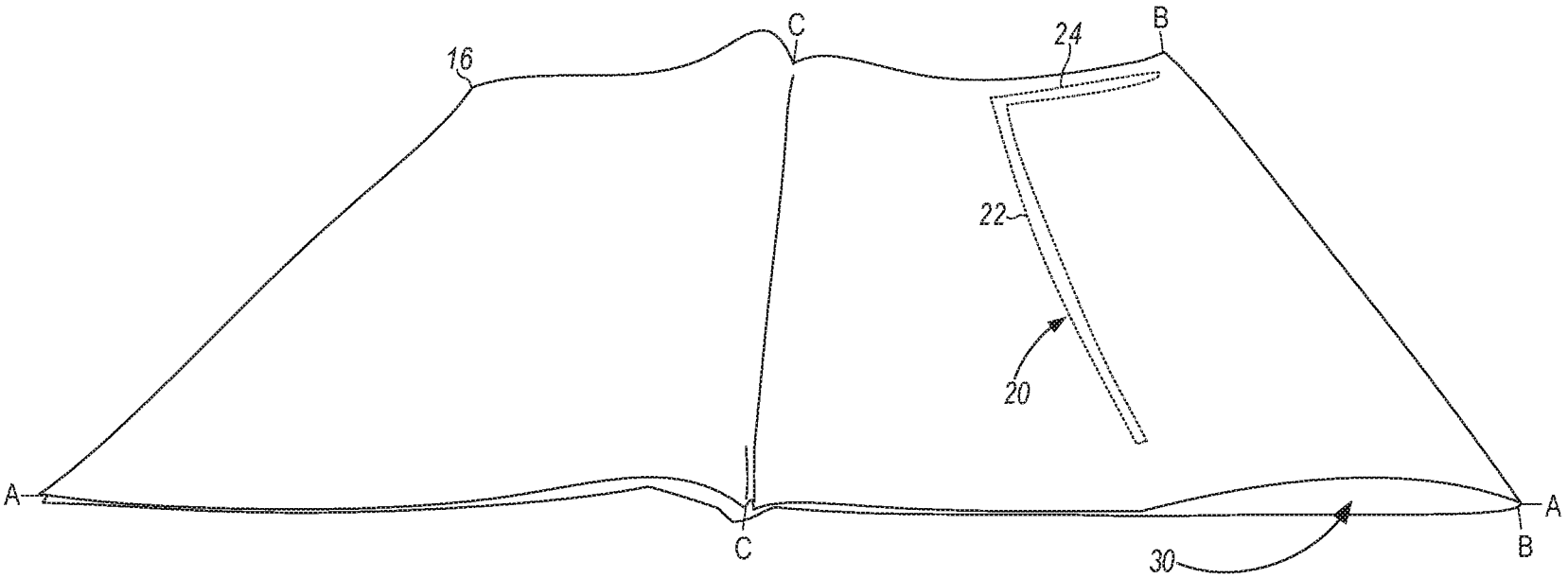
FIG. 5 illustrates a top end view of the napkin sheet of FIG. 3 better illustrating the utensil pocket in a sample embodiment.

FIG. 5 illustrates a top end perspective view of the napkin sheet 10 of FIG. 3 better illustrating the utensil pocket 30 in a sample embodiment.

Figure 6:
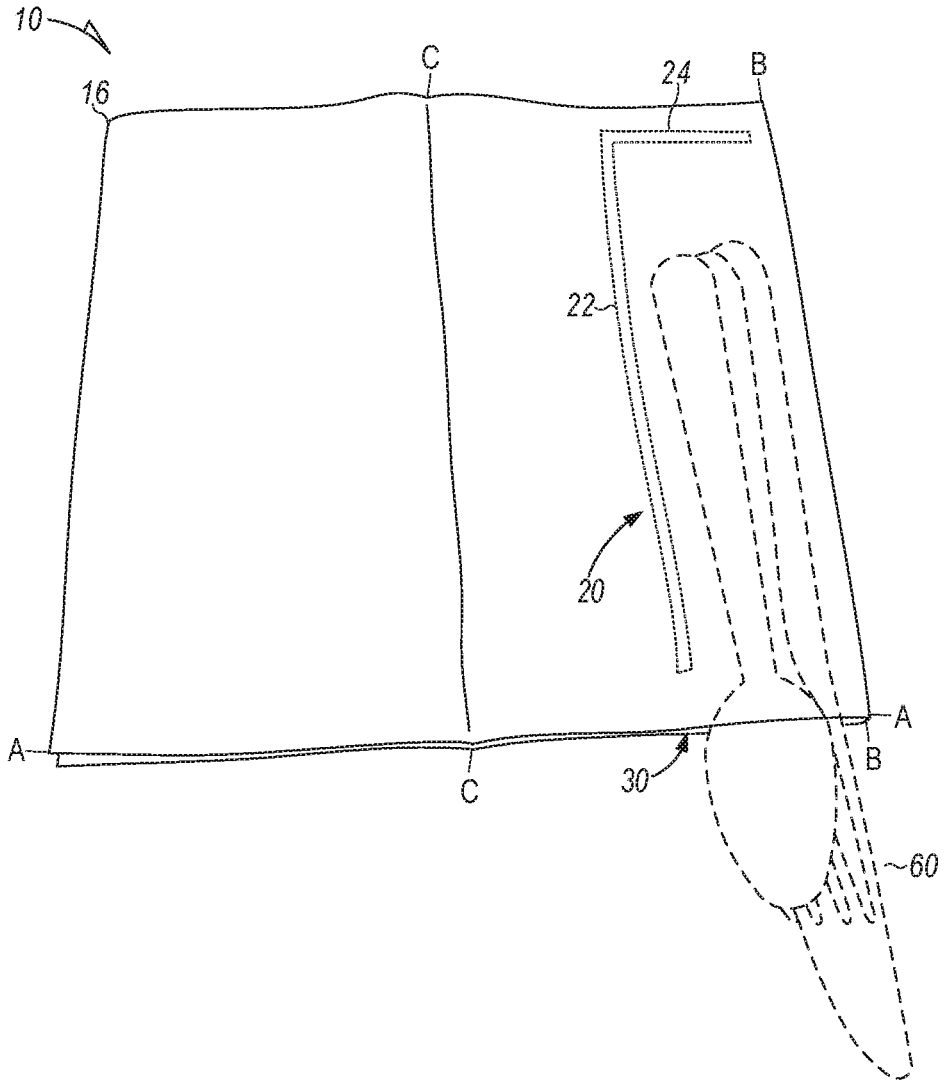
FIG. 6 illustrates a top view of the napkin sheet of FIG. 3 with utensils inserted into the utensil pocket in a sample embodiment.

FIG. 6 illustrates a top view of the napkin sheet 10 of FIG. 3 with utensils 60 inserted into the utensil pocket 30. To complete the place setting, after the utensil(s) are inserted into the pocket 30 of the napkin sheet 10, the napkin sheet 10 is folded along fold line C-C. The napkin sheet 10 may also be rolled in a direction perpendicular to fold line B-B to form a rolled place setting, as desired.

Figure 7:
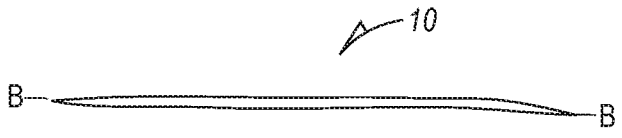
FIG. 7 illustrates a left side view of the napkin sheet of FIG. 3 in a sample embodiment.

FIG. 7 illustrates a left side view of the napkin sheet of FIG. 3 in a sample embodiment.

Figure 8:
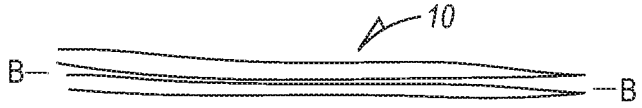
FIG. 8 illustrates a right side view of the napkin sheet of FIG. 3 in a sample embodiment.

FIG. 8 illustrates a right side view of the napkin sheet of FIG. 3 in a sample embodiment.

Figure 9:
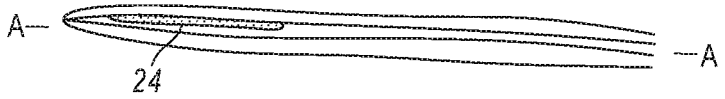
FIG. 9 illustrates a bottom end side view of the napkin sheet of FIG. 3 in a sample embodiment.

FIG. 9 illustrates a bottom end side view of the napkin sheet of FIG. 3 in a sample embodiment. As indicated, the bottom 24 of the pocket 30 may be seen.

In sample embodiments, the napkin sheet 10 having a utensil pocket 30 as described herein may comprise a paper napkin that is inserted into an automated folding machine adapted to provide glue from a glue gun after the first fold along axis A-A to form the L-shaped region including sides 22 and 24 before completing the remainder of the folds. For example, an automatic paper napkin machine of the type provided by Birla Hi Tech, Ean Machinery, or a number of other manufacturers may be used to form the paper napkins described herein. In addition to printing, embossing, counting, and folding, the automatic paper napkin machine may be adapted to insert glue between the folds to form a pocket as described herein. Plastic utensils may be inserted in an assembly line, or plastic or metal utensils may be inserted by a human to complete a place setting. In the case of a paper napkin and plastic utensils, the place setting may also be sealed in a thin plastic layer for sanitary purposes.

While various implementations have been described above, it should be understood that they have been presented by way of example only, and not limitation. For example, any of the elements associated with the systems and methods described above may employ any of the desired functionality set forth hereinabove. Thus, the breadth and scope of a preferred implementation should not be limited by any of the above-described sample implementations.

I claim:

1. A napkin having a utensil pocket, comprising:

a sheet folded in half along a first fold line and into quarters along a second fold line perpendicular to the first fold line to form a first quarter section and a second quarter section; and a food grade glue applied in an L-shaped pattern on the first quarter section where a longer side of the L-shaped pattern extends parallel to the second fold line and a shorter side of the L-shaped pattern extends parallel to the first fold line, wherein the first quarter section is folded over the second quarter section to engage the food grade glue to glue together the first quarter section and the second quarter section to form the utensil pocket between the first quarter section and the second quarter section, and wherein the sheet is further folded into eights along third and fourth fold lines parallel to the second fold line.

2. The napkin of claim 1, wherein the sheet is made of paper.

3. The napkin of claim 1, wherein the utensil pocket has an opening on a side of the sheet adjacent the first fold line.

* * * * *